US005588844A

United States Patent [19]

Sipe

[11] Patent Number: 5,588,844

[45] Date of Patent: Dec. 31, 1996

[54] VARIABLE ORIENTATION, SURFACE MOUNTED CONNECTOR

[75] Inventor: Lynn R. Sipe, Lewistown, Pa.

[73] Assignee: The Whitaker Corporation, Wilmington, Del.

[21] Appl. No.: 615,382

[22] Filed: Mar. 14, 1996

Related U.S. Application Data

[63] Continuation of Ser. No. 342,934, Nov. 21, 1994, Pat. No. 5,520,545.

[51] Int. Cl.[6] ..... H01R 13/73; H01R 23/72

[52] U.S. Cl. ..... 439/65; 439/74; 439/567; 439/571; 439/907

[58] Field of Search ..... 439/284, 290, 439/291, 295, 62, 65, 74, 567, 571, 572, 907, 954, 217, 218

[56] References Cited

U.S. PATENT DOCUMENTS

| | | | |
|---|---|---|---|
| 3,596,235 | 7/1971 | Teurlings et al. | 439/907 |
| 4,335,931 | 6/1982 | Kinnear | 339/217 S |
| 4,630,876 | 12/1986 | Grunberg et al. | 339/48 |
| 4,668,040 | 5/1987 | Matsuzaki et al. | 339/125 R |
| 4,907,987 | 3/1990 | Douty et al. | 439/571 |
| 4,990,099 | 2/1991 | Marin et al. | 439/284 |
| 5,030,121 | 7/1991 | Noorily | 439/188 |
| 5,098,311 | 3/1992 | Roath et al. | 439/289 |
| 5,106,320 | 4/1992 | Kinnear | 439/295 |
| 5,161,985 | 10/1992 | Ramsey | 439/74 |
| 5,282,757 | 2/1994 | Maeda | 439/374 |

FOREIGN PATENT DOCUMENTS

| | | | |
|---|---|---|---|
| 1001569 | 8/1965 | United Kingdom | 439/65 |

OTHER PUBLICATIONS

"BECON Connector", advertisement, Dec. 1961.

*Primary Examiner*—Gary F. Paumen
*Attorney, Agent, or Firm*—Anton P. Ness

[57] ABSTRACT

The invention relates to a variable orientation, surface mountable connector assembly. Electrical connector 1 comprises an insulative housing 100, a plurality of electrical contacts 200, and a pair of variable orientation board mounts 300. The electrical contacts 200 are mounted in the insulative housing 100 so as to be surface mountable to a printed circuit board 3 regardless of whether the electrical connector 1 is surface mounted vertically or horizontally. Two board mounts 300 are located in corresponding lateral cavities 125 in the insulative housing 100. Each board mount 300 is adapted to be selectively oriented in either a first position corresponding to a vertically mounted electrical connector 1 or a second position corresponding to a horizontally mounted electrical connector 1.

13 Claims, 8 Drawing Sheets

VARIABLE ORIENTATION, SURFACE MOUNTED CONNECTOR

This application is a continuation of application Ser. No. 08/342,934 filed Nov. 21, 1994, now U.S. Pat. No. 5,520, 545, issued May 28, 1996.

FIELD OF THE INVENTION

This invention relates generally to electrical connectors, and more particularly to printed circuit board connector assemblies.

BACKGROUND OF THE INVENTION

According to U.S. Pat. No. 5,098,311, an electrical interconnect system my be formed which includes an electrical connector in which both an insulative housing and electrical contacts are hermaphroditic (i.e., an electrical connector adapted to mate with an identical electrical connector). The electrical contacts are adapted to be surface mounted onto a printed circuit board when the electrical connector is positioned in a vertical orientation with respect to the printed circuit board's surface. The electrical connector is fastened in place on the surface of the printed circuit board by a fixed-orientation molded protrusion that extends from the underside of the insulative housing. Two such electrical connectors are mated together by first placing one connector in inverted relation to the other, and then moving the connectors in a straight line toward each other.

According to U.S. Pat. No. 5,161,985, an electrical connector may be formed which is adapted to interconnect with an identical electrical connector. Each electrical connector is adapted to be surface mountable only in a vertical position on a printed circuit board. The electrical connector includes two sets of electrical contacts disposed in spaced-apart supporting walls, with one wall being shorter than the other. Two such electrical connectors are interconnected by placing one connector in inverted relation to the other, and then moving the two connectors in a straight line toward each other.

SUMMARY OF THE INVENTION

The present invention provides a variable orientation, surface mountable connector comprising an insulative housing and a plurality of electrical contacts that are mounted in the insulative housing so as to be surface mountable to a printed circuit board regardless of whether the electrical connector is surface mounted vertically or horizontally thereto. Two board mounts are laterally disposed in corresponding lateral cavities in the insulative housing. Each board mount is adapted to be selectively oriented between (i) a first position wherein the electrical connector will be oriented vertically with respect to the printed circuit board, and (ii) a second position wherein the electrical connector will be oriented horizontally with respect to the printed circuit board.

One objective of the present invention is to provide an electrical connector that may be surface mounted onto a printed circuit board with either a horizontal or a vertical orientation.

A feature of the present invention resides in an electrical connector which includes electrical contacts, wherein the electrical contacts are constructed so as to have a surface mount solder terminal that is exposed on two operative sides of the electrical connector's insulative housing for surface mounting the electrical connector with either a horizontal or vertical orientation on a Printed circuit board (PCB).

Another feature of the present invention resides in a board lock that is adapted for selectively mounting the electrical connector on to a PCB in one of two orientations.

BRIEF DESCRIPTION OF THE DRAWINGS

The preferred embodiment of the invention will now be described, by way of example, with reference being made to the accompanying drawings wherein like numerals refer to like parts and further wherein.

DETAILED DESCRIPTION OF THE PREFERRED EMBODIMENT

Figure 1:
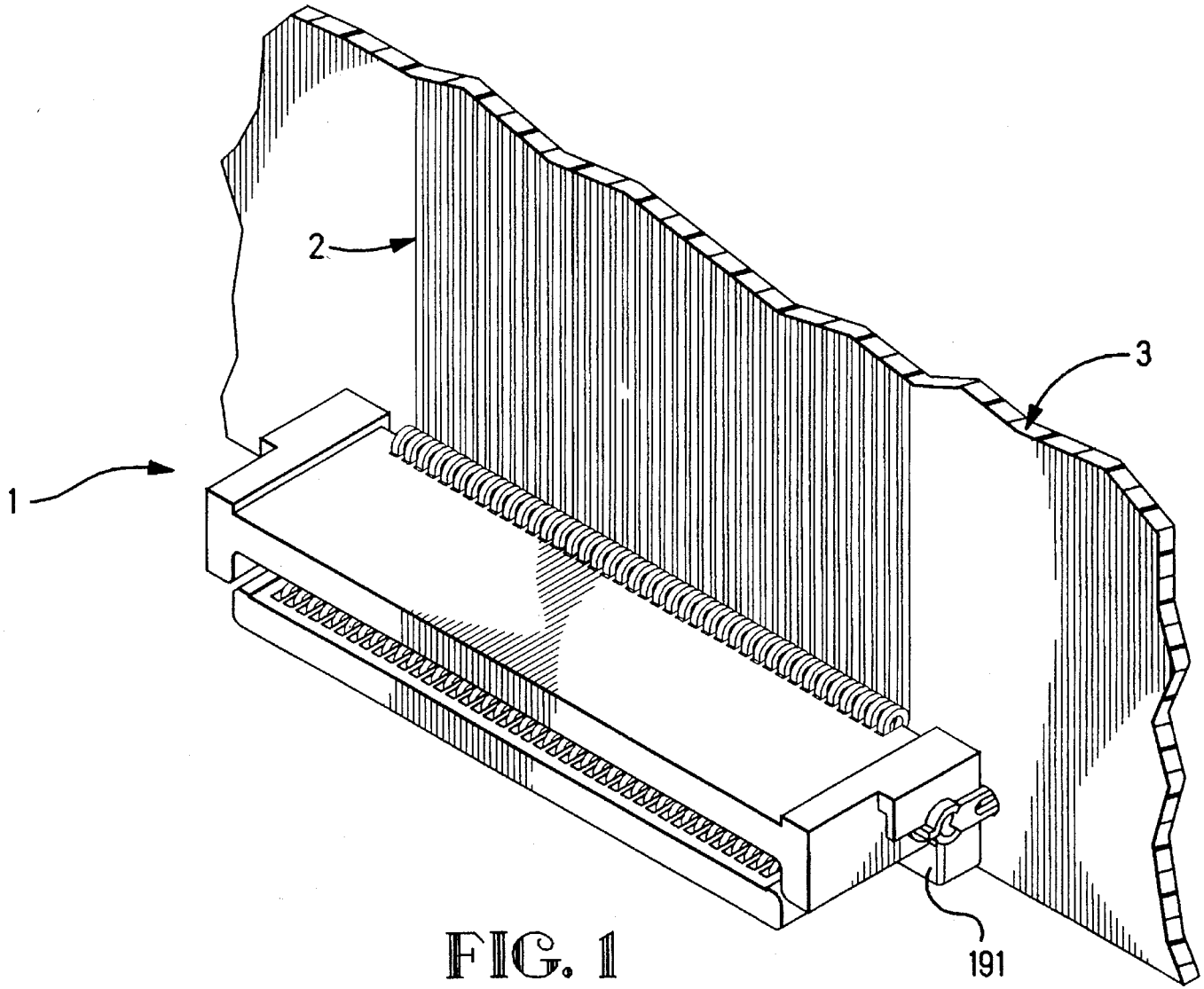
FIG. 1 is a perspective view, partially broken away, showing the electrical connector of the present invention vertically surface mounted to a printed circuit board.
Figure 2:
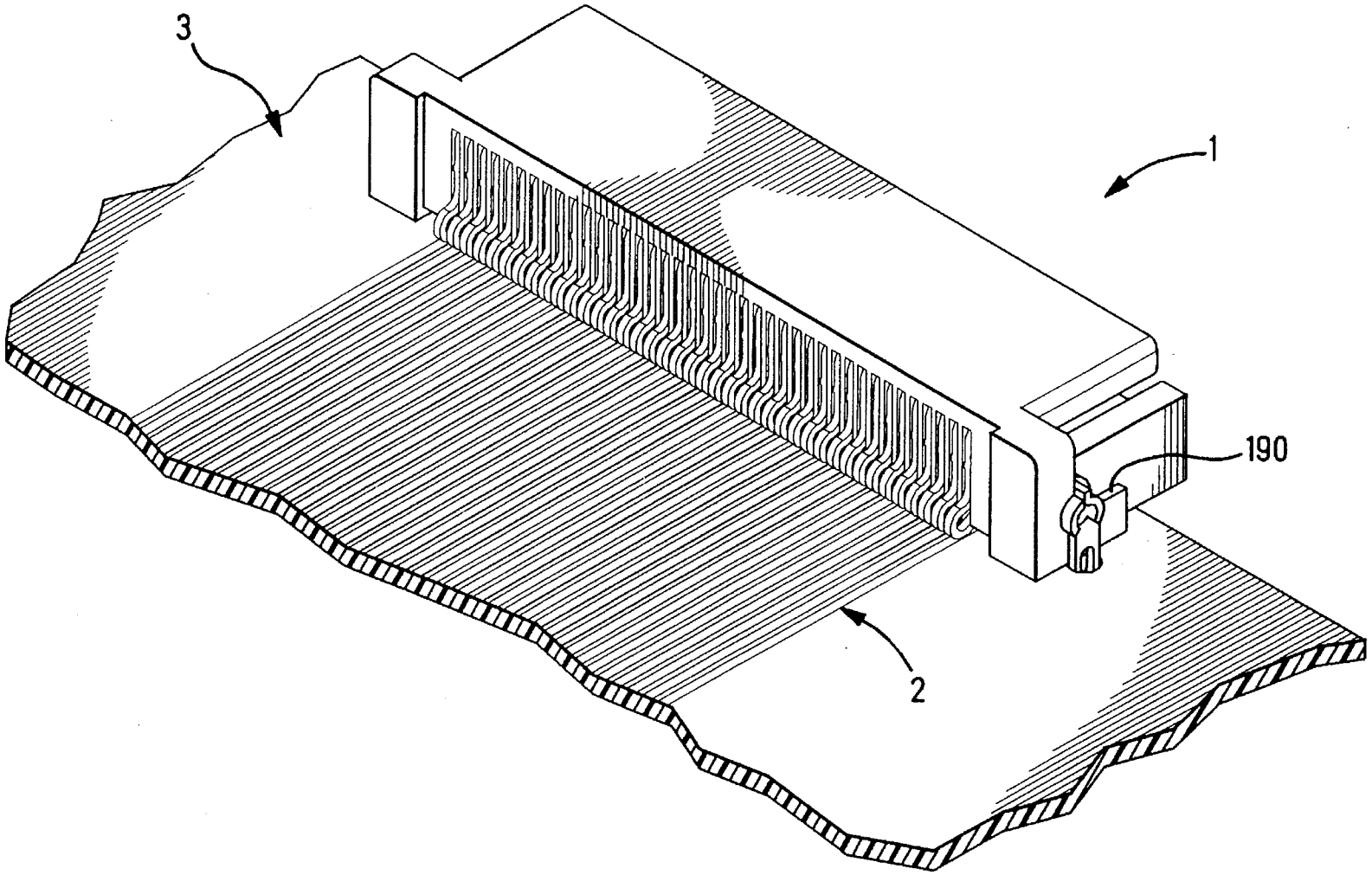
FIG. 2 is a perspective view, partially broken away, showing the electrical connector of the present invention horizontally surface mounted to a printed circuit board.

Referring first to FIGS. 1 and 2, an electrical connector 1 formed in accordance with the present invention may be soldered, either horizontally or vertically, to a surface mount solder pad 2 on a PCB 3. In a preferred embodiment, electrical connector 1 comprises an insulative housing 100 (FIGS. 3–5), a plurality of electrical contacts 200 (FIGS. 9 and 10), and a pair of variable orientation board mounts 300

Figure 11:
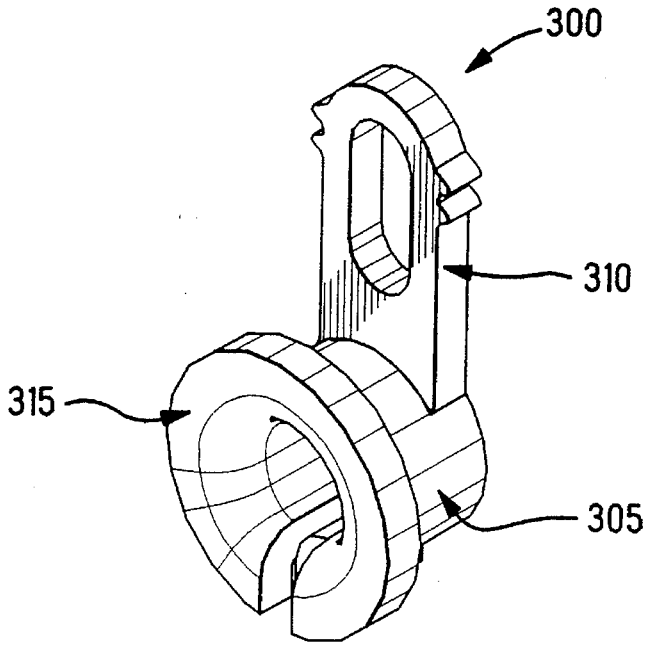
FIG. 11 is a perspective view of a board mount formed in accordance with the present invention.
Figure 12:
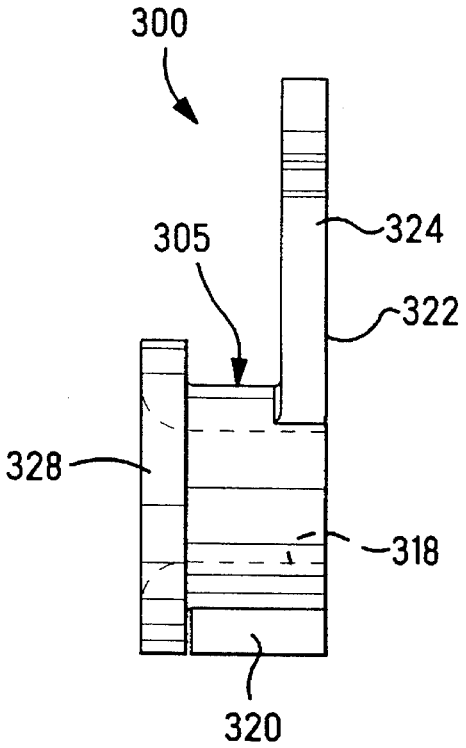
FIG. 12 is a side elevational view of the board mount shown in FIG. 11.
Figure 13:
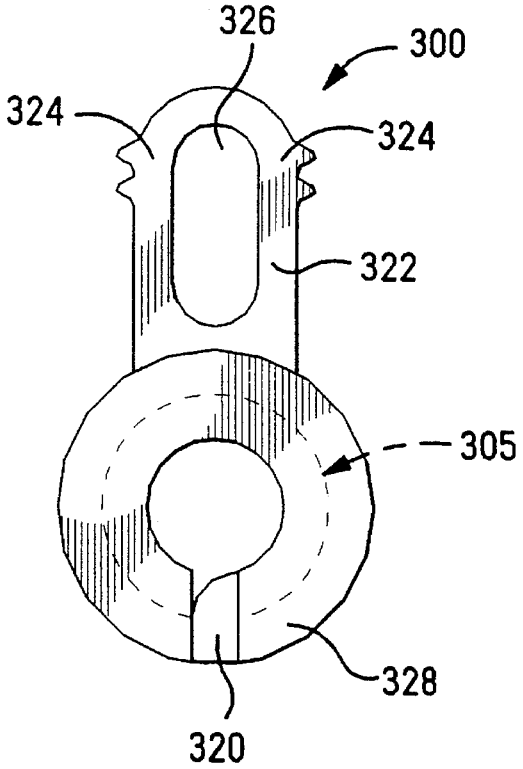
FIG. 13 is a front elevational view of the board mount shown in FIG. 11.

(FIGS. 11–13). Connector 1 may be hermaphroditic and thus be matable with another identical connector 1.

Figure 3:
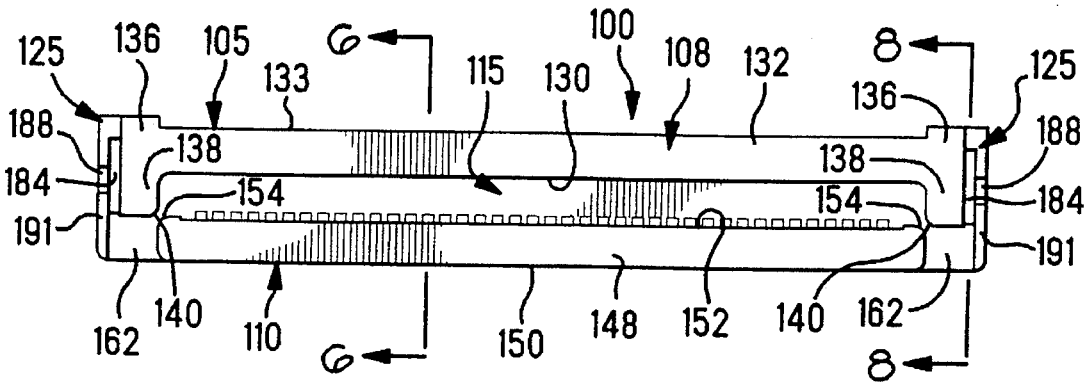
FIG. 3 is a front elevational view of the insulative housing.
Figure 4:
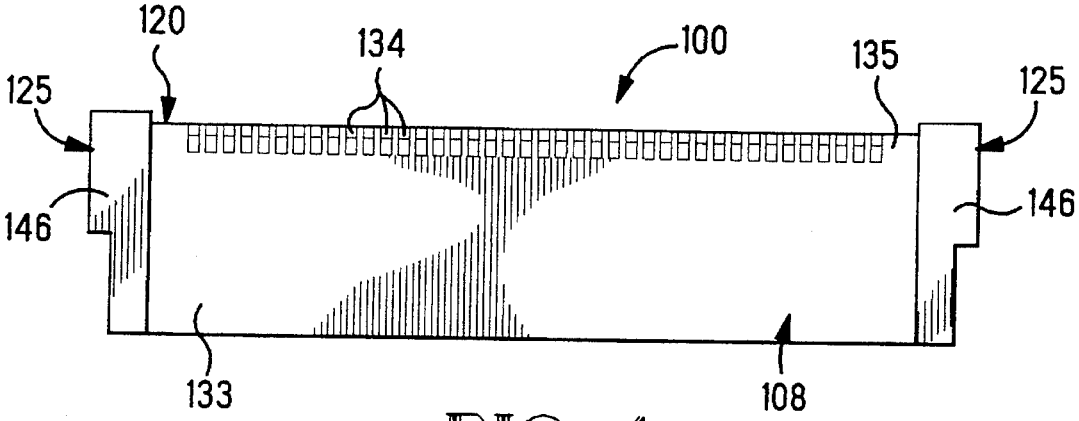
FIG. 4 is a top plan view of the insulative housing.
Figure 5:
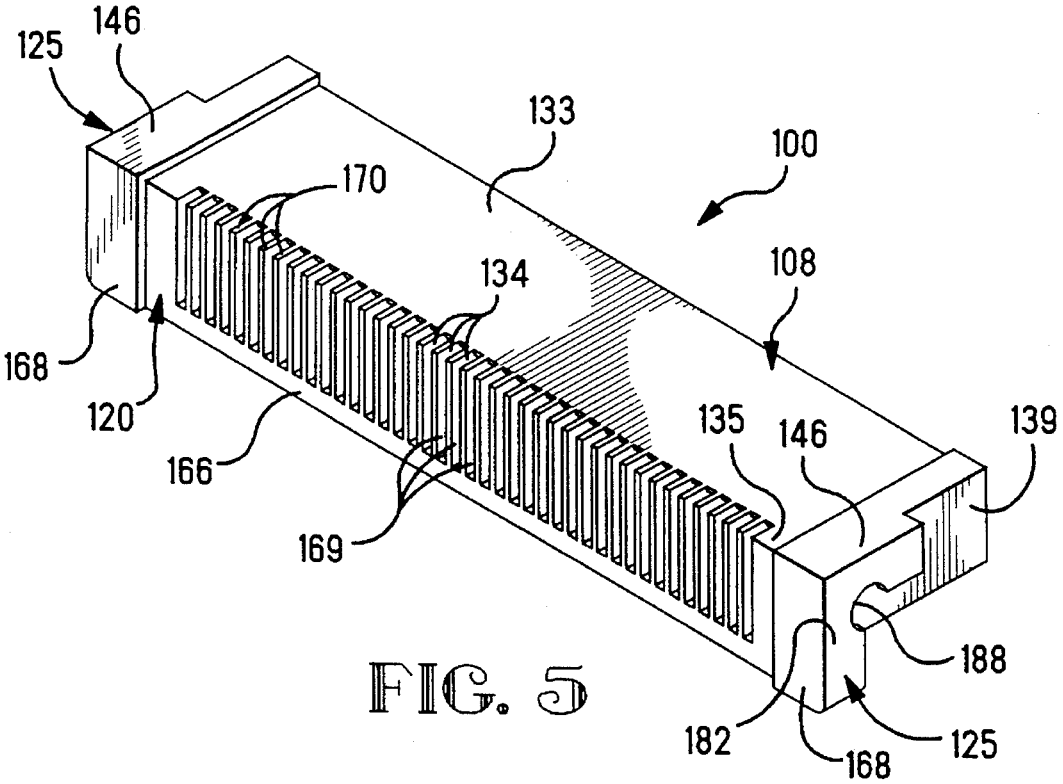
FIG. 5 is a rear perspective view of the insulative housing.

More particularly, and referring now to FIGS. 3, 4, and 5, insulative housing 100 comprises a shell 105, a contact support wall 110, an enclosure 115, a rear wall 120, and two board mount flanges 125. Shell 105 has a side wall 108 that extends outwardly from rear wall 120. Side wall 108 includes an inner mating surface 130, a front face 132, and a recessed outer surface 133. Recessed outer surface 133 includes a plurality of openings 134 disposed in a rear outer portion 135. Two orientation wings 136 are laterally disposed on side wall 108. Orientation wing 136 extend outwardly from both sides of side wall 108, and each includes an outer surface 139. An inboard portion of each orientation wing 136 defines an enclosure end wall 138.

Enclosure end walls 138 are disposed in substantially perpendicular relation to side wall 108, and extend inwardly therefrom. Thus enclosure end walls 138 define enclosure 115 between side wall 108 and contact support wall 110. Enclosure end walls 138 also include rounded inner lateral edges 140. A raised horizontal-mount surface 146 extends from the other ends of orientation wings 136.

Figure 14:
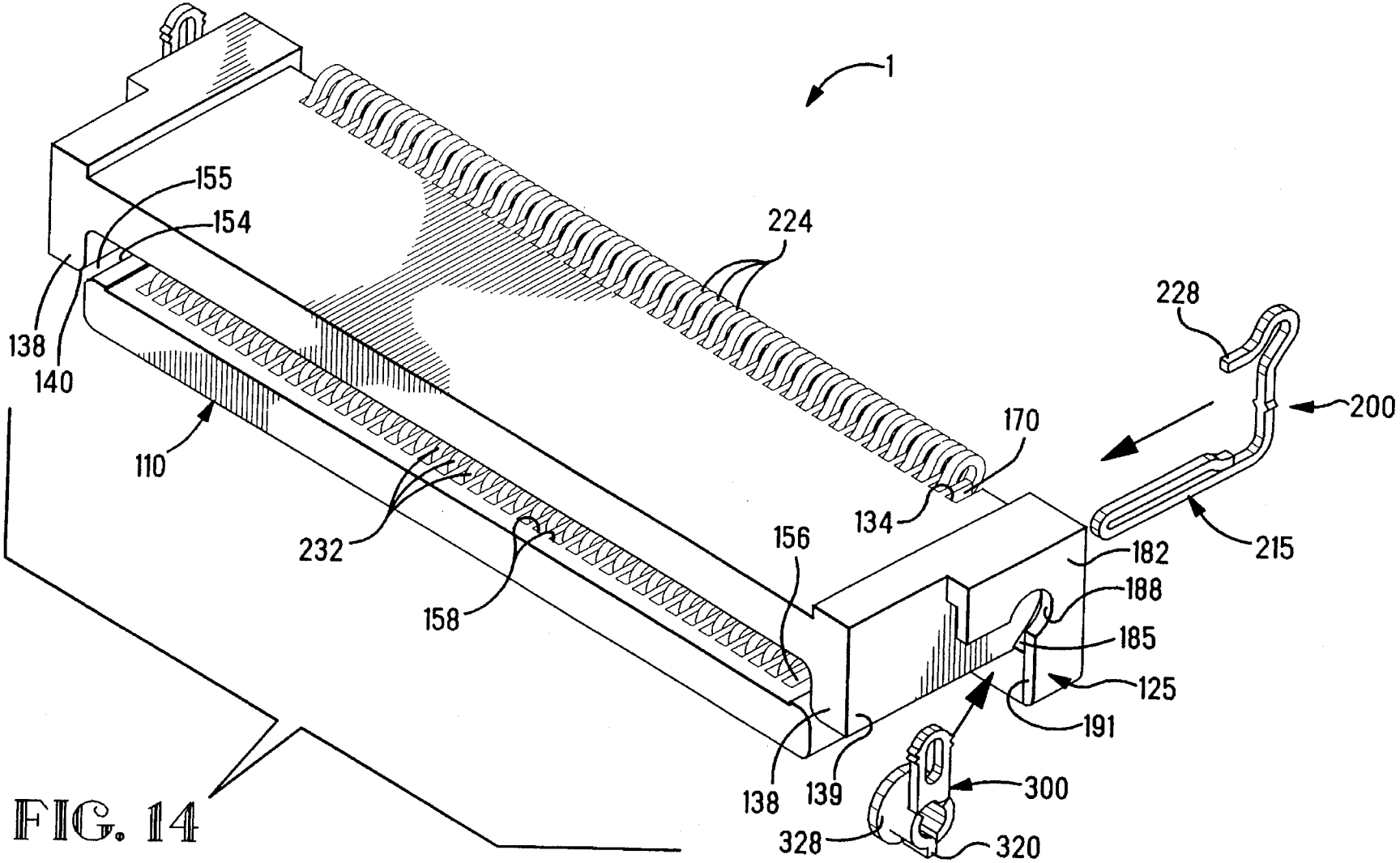
FIG. 14 is a partially exploded perspective view showing the manner of assembly of an electrical connector formed in accordance with the present invention.

Contact support wall 110 extends outwardly from rear wall 120 in substantially parallel confronting relation to shell 105. Contact support wall 110, however, is shorter in length than shell 105, and includes a front face 148, an outer surface 150, and an inner mating surface 152. Inner lateral edges 154 are rounded and raised slightly relative to inner mating surface 152. Inner lateral edges 154 are diagonally-spaced away from inner lateral edges 140 of enclosure end walls 138 so as to form a pair of laterally disposed gaps 155, as best seen in FIG. 14. Gaps 155 provide clearance for an identical mating connector, as will hereinafter be disclosed in further detail.

A plurality of mutually insulated contact cavities 156 (FIGS. 6 and 14) are disposed in contact support wall 110. Contact cavities 156 extend through rear wall 120 and terminate adjacent to front face 148, at shoulder 149. Each contact cavity 156 communicates with enclosure 115 through a plurality of elongate openings 158 (FIGS. 6 and 14) disposed in inner mating surface 152.

Rear wall 120 includes an inner surface 160 (FIG. 6) that extends between shell inner mating surface 130 and contact support wall inner mating surface 152. Lateral rear wall surfaces 162 (FIG. 3) extend outwardly from a rear portion of each enclosure end wall 138 and a rear portion of each lateral edge 154. Outer surface 166 (FIG. 5) of rear wall 120 is recessed between vertical-mounting surfaces 168. A plurality of parallel, vertically extending openings 169 define a plurality of vertical insulating fins 170 in rear wall 120. Vertical openings 169 communicate with openings 134 in recessed outer surface 133 at a first end 172 (FIG. 6), and extend into rear portion 135 of side wall 108 to form blind contact receiving cavities 174. Vertical openings 169 communicate with mutually insulated contact cavities 156 of contact support wall 110 at a second end 176.

Figure 7:
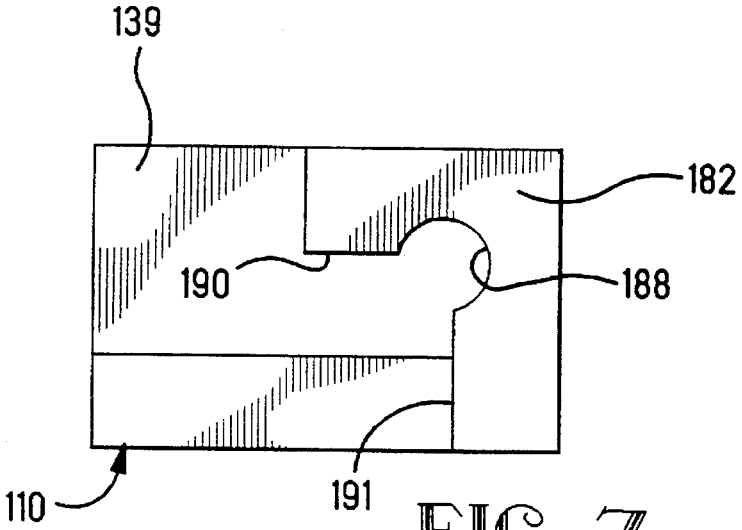
FIG. 7 is a side elevational view of a board mount housing.
Figure 8:
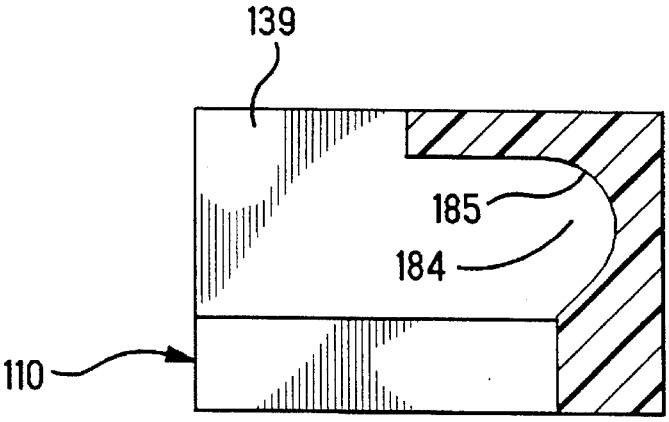
FIG. 8 is a cross-sectional view, as taken along line 8—8 in FIG. 3, showing the internal structure of a board mount cavity.

Board mount flanges 125 (FIGS. 3, 5, 7 and 8) comprise an outer wall 182, an inner cavity 184, a curved inner surface 185, a key hole 188, and rotation limiting surfaces 190 and 191. Board mount flanges 125 are positioned on lateral outer rear portions of orientation wings 136. Lateral surfaces 162 (FIG. 3) extend to and are coplanar with a lower portion of board mount flanges 125. Each board mount flange 125 includes outer wall 182 (FIG. 7 and 14) that is spaced away from outer surface 139 of orientation wings 136, thus forming inner cavity 184 (FIGS. 3 and 8). Curved board mount inner surface 185 (FIG. 8) is disposed within inner cavity 184 between outer surface 139 of orientation wing 136 and outer wall 182. Outer wall 182 comprises key hole 188 having an opening that is sized so as to provide for a snap-fit of board mounts 300, as will hereinafter be disclosed in further detail. Rotation limiting surfaces 190 and 191 (FIGS. 3, 5, 7 and 14) extend outwardly in mutually perpendicular relation from key hole 188 to provide vertical (surface 190) or horizontal (surface 191) orientation to insulative housing 100 when board mount 300 is selectively positioned within flange 125.

Figure 9:
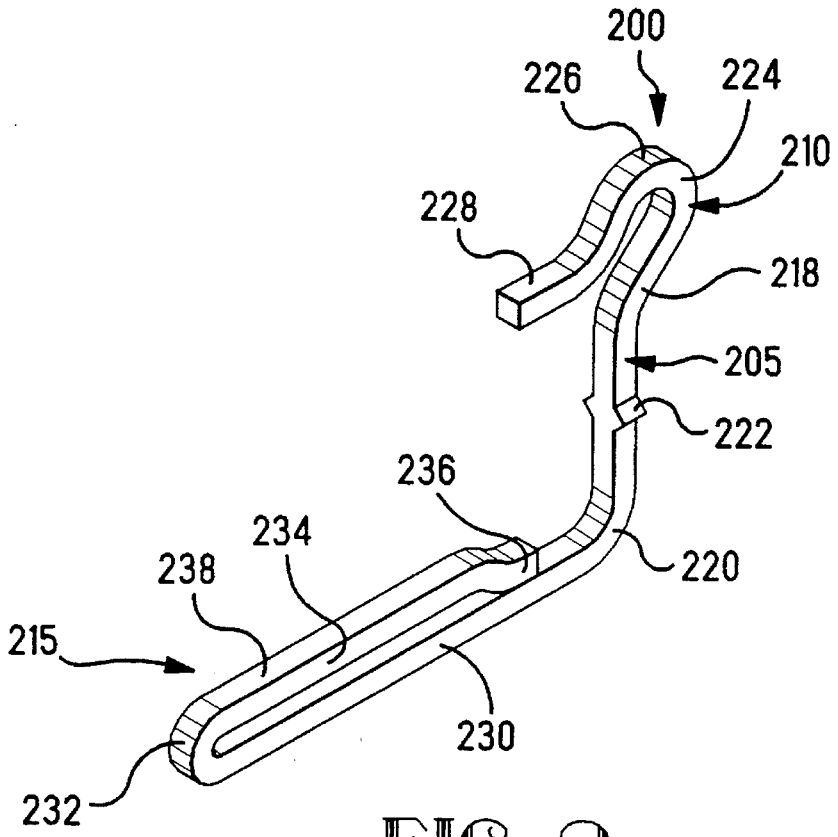
FIG. 9 is a perspective view of an electrical contact formed in accordance with the present invention.
Figure 10:
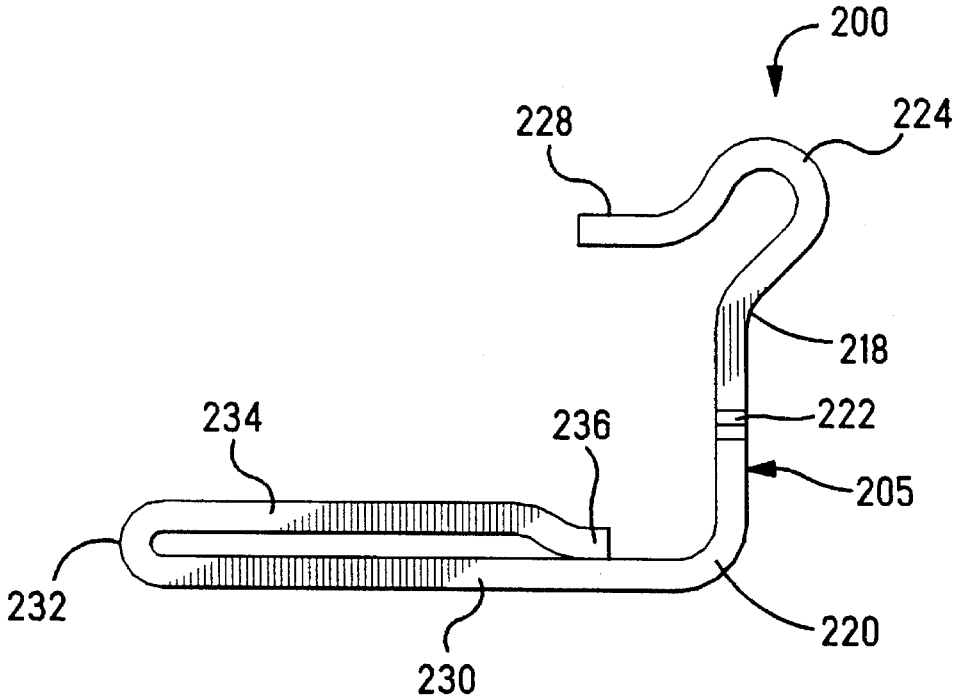
FIG. 10 is a side elevational view of the electrical contact shown in FIG. 9.

Referring now to FIGS. 9 and 10, electrical contacts 200 comprise a unitary construction and include a linking beam portion 205, a surface mount terminal portion 210, and a contact mating portion 215 each disposed in coplanar relation to the other.

More particularly, linking beam portion 205 extends from surface mount terminal portion 210, at a first end 218, to contact mating portion 215 at a second end 220. Synclinal projections 222 are disposed on opposing sides of linking beam portion 205, midway between first end 218 and second end 220. Synclinal projections 222 are sized so as to fixedly engage adjacent vertical insulating fins 170 in rear wall 120, and thereby fasten electrical contacts 200 to insulative housing 100.

Surface mount terminal portion 210 comprises a generally U-shaped solder terminal 224. U-shaped solder terminal 224 is curved so as to always place an adequate portion of outer surface 226 in close mechanical and electrical contact with solder pad 2. Of course, outer surface 226 may be selectively electroplated with various metals known in the art for their solderability and durability (e.g. gold, tin, tin-lead, etc.). Outer surface 226 of U-shaped solder terminal 224 is adapted to be soldered to corresponding surface mount solder pad 2 on PCB 3 regardless of whether electrical connector 1 is mounted vertically (FIG. 1) or horizontally (FIG. 2).

More particularly, U-shaped solder terminal 224 is sized and positioned on electrical contact 200 so that when electrical contact 200 is assembled to insulative housing 100, solder terminal 224 is exposed on two operative sides of insulative housing 100. That is to say, one portion of solder terminal 224 will project above recessed outer surface 133 and another portion of solder terminal 224 will project beyond surface 166 (FIGS. 1, 2, and 14). In this way, electrical connector 1 may be either vertically or horizontally surface mount soldered to PCB 3.

Solder terminal 224 terminates in a relatively straight portion 228 that is oriented, with respect to linking beam 205, so as to be captured in blind cavities 174 of insulative housing 100 when synclinal projections 222 fully engage vertical insulating fins 170, as will hereinafter be disclosed in further detail. Straight portion 228 acts as a support for solder terminal 224 during vertical or horizontal mounting of electrical connector 1 to PCB 3.

Contact mating portion 215 includes a base portion 230 extending outwardly from second end 220 of linking beam portion 205. Base portion 230 merges into a curved nose portion 232 that is spaced away from second end 220 of linking beam portion 205. Nose portion 232 is bent about 180 degrees with respect to base portion 230 and merges with contact beam portion 234. Contact beam portion 234 extends back toward second end 220 of linking beam portion 205 far enough so as to provide both flexibility and enough contact surface to allow for significant contact wiping during mating with a corresponding identical electrical contact.

Contact beam portion 234 is spaced away from base portion 230 by a support portion 236. Support portion 236 provides support to contact beam 234 so as to allow contact beam 234 to compliantly flex during mating, as will be hereinafter disclosed in further detail. Contact beam 234 includes an outer contact surface 238 that is preferably electroplated with a durable metal coating (e.g. gold, AMP Duragold ® (trademark of AMP Incorporated, Harrisburg, Pa., etc.).

In a preferred embodiment, electrical contacts 200 have a rectangular cross-section (as shown in FIGS. 9 and 10), and are formed as a flat stamping from a strip of spring tempered metal. Of course, it will be understood by those skilled in the art that other cross-sections and manufacturing methods will be equally well suited for use in forming electrical contacts 200 in accordance with the present invention.

Referring now to FIGS. 11–13, variable orientation board mounts 300 are formed with a unitary construction, and comprise a cylindrical mount portion 305, a board lock portion 310, and a flared retaining portion 315.

More particularly, cylindrical mount portion 305 extends outwardly from flared retaining portion 315, and includes a central passageway 318. A stop 320 extends radially outward along the length of cylindrical mount 305, and is adapted to engage rotation limiting surfaces 190 or 191 on outer wall 182 of board mount flanges 125 (FIGS. 1, 2 and 14).

Board lock portion 310 comprises a slotted post portion 322 having two barbed spring members 324 that extend along opposite sides of a closed slot 326. Barbed spring members 324 are joined together at each end. Slotted post portion 322 is for insertion into an aperture in PCB 3. Barbed spring members 324 and closed slot 326 are dimensioned so as to create an interference fit between the PCB aperture and slotted post 322. Further details of slotted post 322 and its interaction with a PCB aperture are taught in U.S. Pat. No. 4,907,987, which is incorporated herein by reference.

Flared retaining portion 315 comprises a circular flange 328 that is unitary with cylindrical mount portion 305. Circular flange 328 projects radially outward from the perimeter of cylindrical mount portion 305, and is disposed in spaced-away relation to board lock 310. Flared retaining portion 315 is sized so as to (i) properly position board mount 300 within board mount flange 125, and (ii) allow board mount 300 to be selectively rotated through at least 90 degrees so as to provide for vertical or horizontal mounting of electrical connector 1 on PCB 3 (FIGS. 1 and 2), as will hereinafter be disclosed in further detail.

Figure 6:
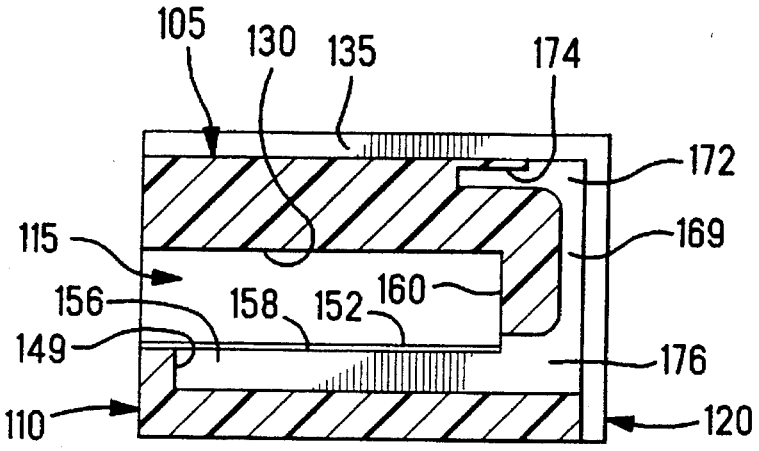
FIG. 6 is a cross-sectional view, as taken along line 6—6 in FIG. 3, showing the internal structure of an electrical contact cavity.

Referring now to FIG. 14, an electrical connector in accordance with the present invention is assembled as follows. First, electrical contacts 200 are stitched into contact cavities 156. More particularly, electrical contacts 200 are positioned so that nose portion 232 is located adjacent to second end 176 (FIG. 6) of contact cavity 156 (as shown in FIG. 14). In this position, straight portion 228 of each electrical contact 200 is located in opposing relation to blind cavity 174, at first end 172 of vertical openings 169 in insulative housing 100. From this position each electrical contact 200 is moved toward insulative housing 100 until synclinal projections 222 fixedly engage adjoining vertical insulating fins 170. As this occurs, straight portion 228 is captured in blind cavity 174. At the same time, contact mating portion 215 enters contact cavity 156 at second end 176 (FIG. 6). When each electrical contact 200 is fully installed in insulative housing 100, contact beam portion 234 projects into enclosure 115. In this position, nose portion 232 rests adjacent to shoulder 149 within cavity 156 (FIG. 14). Also, surface mount solder terminal 224 projects from both recessed outer surface 133 and outer surface 166, thus providing for vertical or horizontal surface mounting of electrical connector 1.

Once all of electrical contacts 200 have been stitched into insulative housing 100, board mounts 300 may be positioned within board mount cavities 125. More particularly, and still referring to FIG. 14, board mounts 300 are positioned adjacent to cavity 125 with circular flange 328 positioned inboard so as to be adjacent to orientation wing outer surface 139. In this position, board mount 300 is moved into flange 125 until cylindrical mount portion 305 snaps into key hole 188 and circular flange 328 comes to rest on curved inner surface 185. In this position, cylindrical mount portion 305 is rotatably captured within keyhole 188, and board lock 310 is positioned outboard of outer wall 182. Depending on the mounting orientation desired, board mount 300 may be rotated so that stop 320 engages either surface 190 (for vertically mounting electrical connector 1 to printed circuit board 3, as seen in FIG. 1) or surface 191 (for horizontally mounting electrical connector 1 to printed circuit board 3, as seen in FIG. 2).

Referring now to FIGS. 1, 2, 15, and 16, electrical connector 1 is interconnected to an identical electrical connector in the following manner. Each electrical connector 1 is first mounted to printed circuit board 3 in either a vertical or horizontal position. More particularly, to vertically mount electrical connector 1 onto printed circuit board 3, board mount 300 is rotated until stop 320 engages limiting surface 190 (FIG. 1). Once in this position, electrical connector 1 is positioned so that slotted posts 322 of each board mount 300 are positioned above apertures in printed circuit board 3. Electrical connector 1 is then press fit onto printed circuit board 3 until barbed spring members 324 fully engage the inner surface of the printed circuit board aperture. It is important to note that as this occurs, each electrical contact's outer surface 226 of U-shaped solder terminal 224 engages surface mount solder pad 2, thus creating a high pressure mechanical interface therewith.

A second electrical connector 1 may be mounted to printed circuit board 3 in a horizontal position (FIG. 2) as follows. Board mounts 300 are rotated until stop 320 engages limiting surface 191. In this position, electrical connector 1 is press fit into the printed circuit board apertures in a manner similar to that described above in connection with the vertical mounting of electrical connector 1. Again, it is important to note that once electrical connector 1 is fully seated in a horizontal configuration on printed circuit board 3, outer surface 226 of electrical connector 200 makes a high pressure mechanical interface with surface mount solder pad 2.

Once vertically or horizontally mounted to printed circuit board 3, electrical connector 1 may be surface mount soldered to printed circuit board 3 by any of the various surface mount technology soldering methods well known in the art. After the surface mount soldering process is completed, electrical connector 1 may be mated to another identical electrical connector 1.

By way of example, the two electrical connectors described above and shown in FIGS. 1 and 2 may be mated together to form an hermaphroditic connector assembly as follows. To begin with, it should be noted that one of the electrical connectors is always placed in an inverted orientation with respect to the other electrical connector.

More particularly, one electrical connector is placed in an orientation so that its contact support wall 110 is positioned in opposing relationship to enclosure 115 of the other electrical connector 1. 0f course, in this configuration the other electrical connector has its contact support wall 110 similarly positioned in opposing relationship to the first electrical connector's enclosure 115. This relative mating relationship between each of the electrical connectors is required regardless of how each is mounted (horizontally or vertically) to its respective PCB.

Figure 15:
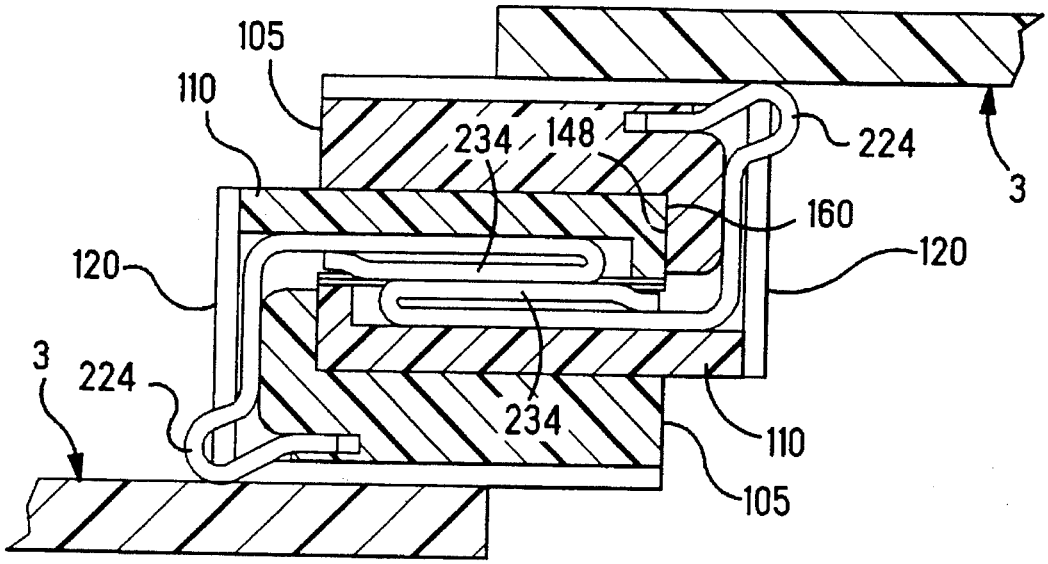
FIG. 15 is a cross-sectional view of a pair of fully mated, horizontally surface mounted electrical connectors formed in accordance with the present invention.
Figure 16:
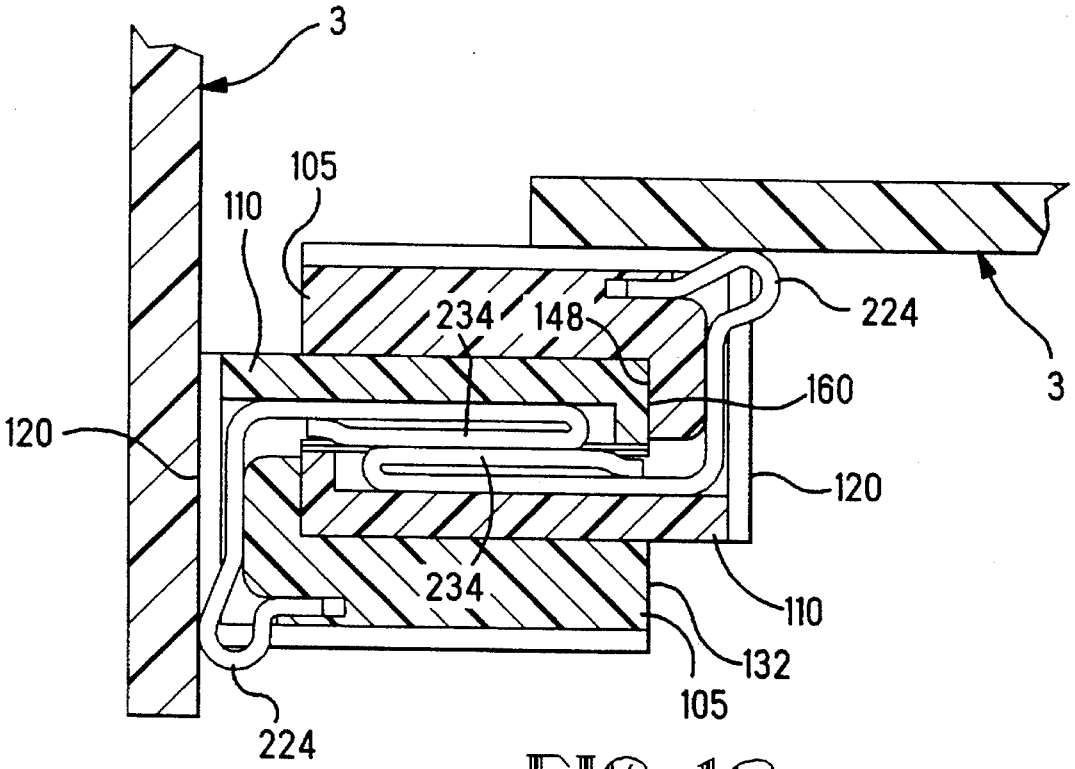
FIG. 16 is a cross-sectional view of a pair of fully mated electrical connectors formed in accordance with the present invention, with one of the electrical connectors being shown in a horizontally surface mounted configuration, and the other electrical connector being shown in a vertically surface mounted configuration.

Once in this position, the connectors are moved in a straight line toward one another so that each of their respective contact support walls 110 enters each of their respective enclosures 115. At the same time, their respective gaps 155 (FIG. 14) come into alignment, thus providing sufficient clearance therebetween to allow the respective enclosure end walls 138 to pass along the lateral sides of each contact support wall 110 until each contact support wall front face 148 engages each rear wall inner surface 160 and lateral surface 162 (FIGS. 15 and 16). As this occurs, outer contact surfaces 238 of the respective contact beams 234 slidingly engage. The engaging of outer contact surfaces 238 causes contact beams 234 to flex toward their respective base portions 230, about nose portion 232 and support portion 236. The sliding engagement of outer contact surfaces 238 provide wiping action that removes any unwanted dielectric materials from between contact surfaces 238. Electrical connectors 1 may be disconnected by simply moving them apart along a straight line.

Other embodiments, features and advantages of the present invention are intended to be covered by the spirit and scope of the appended claims.

What is claimed is:

1. An electrical connector comprising an insulative housing and a plurality of electrical contacts, each of said contacts being mounted in said housing so as to be surface mountable to a printed circuit board regardless of whether said electrical connector is mounted vertically or horizontally thereto, and two board mounts laterally disposed in two corresponding cavities, wherein each of said board mounts is adapted to rotate relative to said housing between (i) a first position wherein said electrical connector is oriented vertically with respect to said printed circuit board when surface mounted thereto, and (ii) a second position wherein said electrical connector is oriented horizontally with respect to said printed circuit board when surface mounted thereto.

2. An electrical connector according to claim 1 wherein said electrical contacts comprise:

a linking beam portion comprising a first end and a second end and including at least two synclinal projections disposed on opposing sides of said linking beam portion, said synclinal projections being sized so as to engage a portion of said insulative housing thereby retaining said electrical contacts in position in said insulative housing;

a surface mount terminal portion having a U-shape and being adapted to mate with a surface mount PCB solder pad along an extended portion of said U-shaped terminal's outer surface and further wherein said U-shaped terminal comprises a relatively straight portion adapted to be received by an opening in said insulative housing; and a contact mating portion including a base portion extending outwardly from said second end of said linking beam portion to a curved nose portion and a contact beam portion that extends back toward said second end of said linking beam portion, said contact beam portion being positioned in spaced-apart relation from said base portion by a support portion disposed at a free end of said contact beam portion, said support portion being adapted to provide support so as to allow compliant flexing of said contact beam portion during mating of said electrical connector.

3. An electrical connector according to claim 2 wherein said linking beam portion, said surface mount terminal portion, and said contacting beam portion are all aligned in coplanar relation with one another.

4. An electrical connector according to claim 2 wherein said outer surface of said U-shaped terminal portion comprises tin.

5. An electrical connector according to claim 1 wherein each of said board mounts comprise:

a cylindrical mount portion having a central passageway and a stop portion, said stop extending along the length of said cylindrical mount and adapted to selectively engage corresponding surfaces of a board mount cavity in said insulative housing when said board mounts are in said first position or said second position;

a slotted post extending outwardly from a first end of said cylindrical portion and adapted to engage an aperture in said printed circuit board; and a retaining flare comprising a circular flange extending radially outward from a second end of said cylindrical mount portion and disposed in spaced-apart relation to said slotted post, said retaining flare being sized to fit within said board mount cavity and adapted to freely rotate therein as said board mount moves between said first position and said second position.

6. An electrical connector according claim 1 wherein said insulative housing comprises:

a shell extending from a rear wall of said housing, said shell including a recessed outer surface and two laterally positioned wings, said recessed outer surface having a plurality of openings in a rear portion thereof adapted to receive a solder terminal portion of said electrical contact, said wings comprising a first outwardly projecting portion having an operative outer surface adapted for horizontally mounting said electrical connector to a printed circuit board and a second inwardly projecting portion and further comprising two laterally positioned board mount cavities extending outwardly from a rear portion of said wings, said board mount cavities including an operative outer surface adapted for vertically mounting said electrical connector to said printed circuit board and an outer wall spaced away from an outer wall of said wings so as to form an inner cavity and further including a key hole opening in said outer wall of said board mount cavity adapted to rotatably receive said board mount said board mount outer surface further defining two rotation limiting surfaces disposed at right angles to one another, said rotation limiting surfaces being adapted to engage a portion of said board mount so that said board mount may be selectively oriented between said first position and said second position; and a contact support wall extending outwardly from said rear wall in spaced-apart confronting relation to said shell so as to define an enclosure therebetween wherein said contact support wall is independent of said shell, said contact support wall comprising a plurality of mutually insulated contact cavities communicating between said enclosure and said rear wall and being adapted to receive said electrical contacts.

7. An electrical connector according to claim 6 wherein said contact support wall is shorter in length than said shell.

8. An electrical connector according to claim 6 wherein said electrical contacts comprise a solder terminal portion that is adapted to project outwardly beyond said two operative surfaces of said insulative housing thereby providing for both horizontal and vertical surface mount soldering of said electrical connector.

9. An electrical connector according to claim 6 wherein said wings and said contact support wall comprise rounded lateral edges spaced away from, and in diagonally opposing relation to, one another.

10. An electrical connector according to claim 6 wherein said rear wall comprises a plurality of parallel vertical openings defining a plurality of insulating fins.

11. A surface mount electrical connector comprising, in combination, an insulative housing and a plurality of electrical contacts:

said insulative housing comprising:

a shell extending from a rear wall of said housing including a recessed outer surface and two laterally positioned wings, said recessed outer surface thereof adapted to receive a solder terminal portion of said electrical contacts, said wings comprising a first outwardly projecting portion having an operative outer surface adapted for horizontally mounting said electrical connector to a printed circuit board and a second inwardly projecting portion; and a contact support wall extending outwardly from said rear wall in spaced-away confronting relation to said shell so as to define an enclosure therebetween wherein said contact support wall is independent of said shell, said contact support wall comprising a plurality of mutually insulated contact cavities communicating between said enclosure and said rear wall and being adapted to receive said electrical contacts;

two board mount cavities extending outwardly from a rear portion of each wing and including an operative outer surface adapted for vertically mounting said electrical connector to said printed circuit board, said board mount cavities including an outer wall spaced away from an outer wall of said wings so as to form an inner cavity and further including a key hole opening in said outer wall of said board mount cavity adapted to rotatably receive a board mount, said board mount outer surface defining two rotation limiting surfaces disposed at right angles to one another, said rotation limiting surfaces being adapted to engage a portion of said board mount so that said board mount may be selectively rotated relative to said housing between (i) a first position wherein said electrical connector is oriented vertically with respect to said printed circuit board when surface mounted thereto, and (ii) a second position wherein said electrical connector is oriented horizontally with respect to said printed circuit board when surface mounted thereto, and wherein each of said electrical contacts being mounted in said housing so as to be surface mountable to a printed circuit board regardless of whether said electrical connector is mounted vertically or horizontally thereto.

12. A board mounting system for mounting an electrical connector to a circuit board, the electrical connector having an insulative housing and at least one contact therein, the housing having a mating face defining a mating direction, comprising:

at least one board mount disposed in a corresponding cavity of said housing, said board mount and said cavity being cooperable to permit said board mount to be rotated relative to said housing between a first position associated with a first angle of said mating face with said circuit board, and a second position associated with a second, different angle of said mating face with said circuit board.

13. An electrical connector comprising:

an insulative housing including at least one contact therein having a body extending through said housing from a board-engaging terminal portion extending outwardly of said housing, to a mating contact section exposed at a mating face, said board-engaging terminal portion having a U-shaped outer contact surface whereby the terminal portion is adapted to electrically engage a circuit board pad at at least two locations spaced around said U-shaped outer contact surface thus permitting the connector to be positioned in two different angular orientations with respect to the circuit board.

* * * * *